US006667727B1

(12) United States Patent
Iwaoka

(10) Patent No.: US 6,667,727 B1
(45) Date of Patent: Dec. 23, 2003

(54) PLASMA DISPLAY APPARATUS

(75) Inventor: Shigeru Iwaoka, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/697,737

(22) Filed: Oct. 27, 2000

(30) Foreign Application Priority Data

Feb. 8, 2000 (JP) ..... 2000-030071
Feb. 22, 2000 (JP) ..... 2000-044630

(51) Int. Cl.[7] ..... G09G 3/28

(52) U.S. Cl. ..... 345/60; 315/169.4

(58) Field of Search ..... 345/60, 68, 63, 345/64, 66; 315/169.4

(56) References Cited

U.S. PATENT DOCUMENTS 5,446,344 A * 8/1995 Kanazawa ..... 315/169.4
5,877,734 A * 3/1999 Amemiya ..... 345/60
6,317,105 B1 * 11/2001 Eo et al. ..... 345/68
6,496,164 B1 * 12/2002 Kuwahara et al. ..... 345/60

* cited by examiner

*Primary Examiner*—Dennis-Doon Chow
*Assistant Examiner*—Uchendu O. Anyaso
(74) *Attorney, Agent, or Firm*—Morgan, Lewis & Bockius LLP

(57) ABSTRACT

A plasma display apparatus which is capable of reducing power consumption and achieving a high definition display. A plasma display panel has a plurality of first row electrodes and second row electrodes extending in a horizontal direction and formed in alternation, a discharge space filled with a discharge gas, and a plurality of column electrodes formed opposite to and extending in a direction perpendicular to the first row electrodes and the second row electrodes through the discharge space. The plasma display panel also has discharge cells corresponding to pixels, formed at respective intersections of the first row electrodes and second row electrodes with the column electrodes, and a spacing between each of the first row electrodes and each of the second row electrode is conformed to a display line on the screen. A reset discharge is caused to occur for forming wall charges in all of the discharge cells; a selective erasure discharge for selectively erasing the wall charges formed in the respective discharge cells in accordance with an input video signal; and a sustaining discharge for forcing only those discharge cells formed with the wall charges to repeatedly emit light. According to a second aspect of the present invention, a plasma display apparatus comprises a capacitor, a first switching current path for selectively discharging a charge accumulated on the capacitor to supply the charge to a power supply line, a second switching current path for selectively applying a power supply potential to the power supply line, a third switching current path for selectively charging the capacitor with charges accumulated on column electrodes through the power supply line, and a pixel data pulse generator circuit for connecting the power supply line to the column electrodes for a predetermined period of time in response to the input video signal to generate pixel data pulses corresponding to the input video signal and applying the pixel data pulses onto the column electrodes.

5 Claims, 10 Drawing Sheets

PLASMA DISPLAY APPARATUS

BACKGROUND OF THE INVENTION

1. Field of the Invention

The present invention relates to a plasma display apparatus.

2. Description of Related Art

In recent years, a variety of thin display apparatuses have been brought into practical use in response to a demand for a reduction in thickness of such apparatuses to the accompaniment of an increase in size of the screen. An AC discharge type plasma display panel has drawn attention as one of the thin display apparatuses.

A plasma display panel (PDP) has a plurality of display lines, each of which corresponds to one line of a screen.

A conventional plasma display panel requires a sufficient pitch between display lines in order to prevent an erroneous discharge between the display lines. This results in difficulties in improving the resolution by reducing the pitch between the display lines.

Further, since the coventional plasma display panel cosumes more power than CRT, liquid crystal display and so on, a reduction in power consumption is desired for the plasma display panel.

OBJECT AND SUMMARY OF THE INVENTION

The present invention has been made to solve the problems as mentioned above, and an object of the invention is to provide a plasma display apparatus which is capable of providing a high definition display with low power consumption.

A plasma display apparatus according to a first aspect of the present invention is a plasma display apparatus for displaying an image corresponding to an input video signal, which comprises a plasma display panel including a plurality of first row electrodes and second row electrodes extending in a horizontal direction and formed in alternation, a discharge space filled with a discharge gas, and a plurality of column electrodes formed opposite to and extending in a direction perpendicular to the first row electrodes and the second row electrodes through the discharge space, wherein discharge cells corresponding to pixels are formed at respective intersections of the first row electrodes and second row electrodes with the column electrodes, and a spacing between each of the first row electrodes and each of the second row electrode is conformed to a display line on the screen; reset driving means for causing a reset discharge to occur for forming wall charges in all of the discharge cells; write driving means for causing a selective erasure discharge to occur for selectively erasing the wall charges formed in the discharge cells in accordance with the input video signal and light emission sustain driving means for causing a sustaining discharge to occur for forcing only discharge cells formed with the wall charges therein out of the discharge cells to repeatedly emit light.

A plasma display apparatus according to a second aspect of the present invention is a plasma display apparatus for displaying an image corresponding to an input video signal, which comprises a plasma display panel including a plurality of first row electrodes and second row electrodes extending in a horizontal direction and formed in alternation, a discharge space filled with a discharge gas, and a plurality of column electrodes formed opposite to and extending in a direction perpendicular to the first row electrodes and the second row electrodes through the discharge space, wherein discharge cells corresponding to pixels are formed at respective intersections of the first row electrodes and second row electrodes with the column electrodes, and a spacing between each of the first row electrodes and each of the second row electrode is conformed to each of display lines on the screen; a power supply circuit including a capacitor, a first switching current path for selectively discharging a charge accumulated on the capacitor to supply the charge to a power supply line, a second switching current path for selectively applying a power supply potential to the power supply line, and a third switching current path for selectively charging the capacitor with charges accumulated on the column electrodes through the power supply line; and a pixel data pulse generator circuit for connecting the power supply line to the column electrodes for a predetermined period of time in response to the input video signal to generate pixel data pulses corresponding to the input video signal and applying the pixel data pulses onto the column electrodes.

DETAILED DESCRIPTION OF THE PREFERRED EMBODIMENTS

Prior to describing in detail a plasma display apparatus according to the present invention, an example of a conventional plasma display will be discussed with reference to the accompanying drawings.

Figure 1:
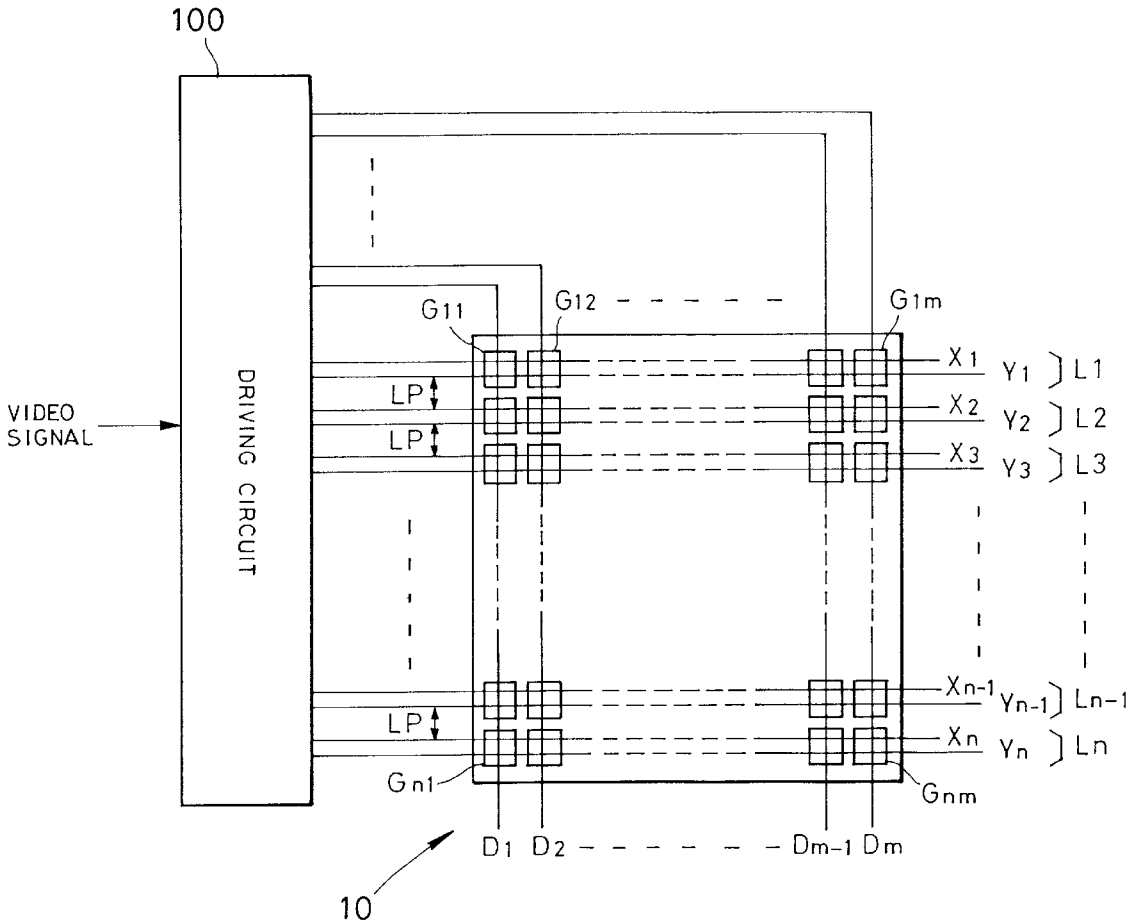
FIG. 1 is a diagram generally illustrating the structure of a conventional plasma display apparatus.

FIG. 1 is a diagram generally illustrating the configuration of a plasma display apparatus which comprises a plasma display panel and a driving unit for driving the plasma display panel.

In FIG. 1, a plasma display panel (PDP) 10 comprises m column electrodes $D_1$–$D_m$ as data electrodes; and n row electrodes $X_1$–$X_n$ and n row electrodes $Y_1$–$Y_n$ which intersect the respective column electrodes $D_1$–$D_m$. These row electrodes $X_1$–$X_n$ and row electrodes $Y_1$–$Y_n$ form pairs of row electrodes X, Y, each of which serves as a display line corresponding to one line on the screen. Stated another way, the PDP 10 is comprised of a number of display lines equal to n, comprised of display lines L1–Ln, as illustrated in FIG. 1. The column electrodes D and the row electrodes X, Y are formed on two glass substrates which are positioned opposite to each other with a discharge space interposed therebetween. Then, as illustrated in FIG. 1, discharge cells G, corresponding to respective pixels, are formed at respective intersections of the display lines L and the column lines D.

In this event, since each of the discharge cells utilizes a discharge phenomenon to emit light, it only has two states, i.e., a "light emitting" state and a "non-light emitting" state. In other words, each cell can represent the luminance only at two levels of gradation, i.e., a minimum luminance (non-light emitting state) and a maximum luminance (light emitting state). Therefore, a driving circuit 100 implements subfield-based gradation driving in order to realize a half-tone luminance display corresponding to a video signal input to the PDP 10. The subfield method converts an input video signal to, for example, n-bit pixel data corresponding to each pixel, and divides one field into n subfields corresponding to respective bit digits of the n-bit pixel data.

Figure 2:
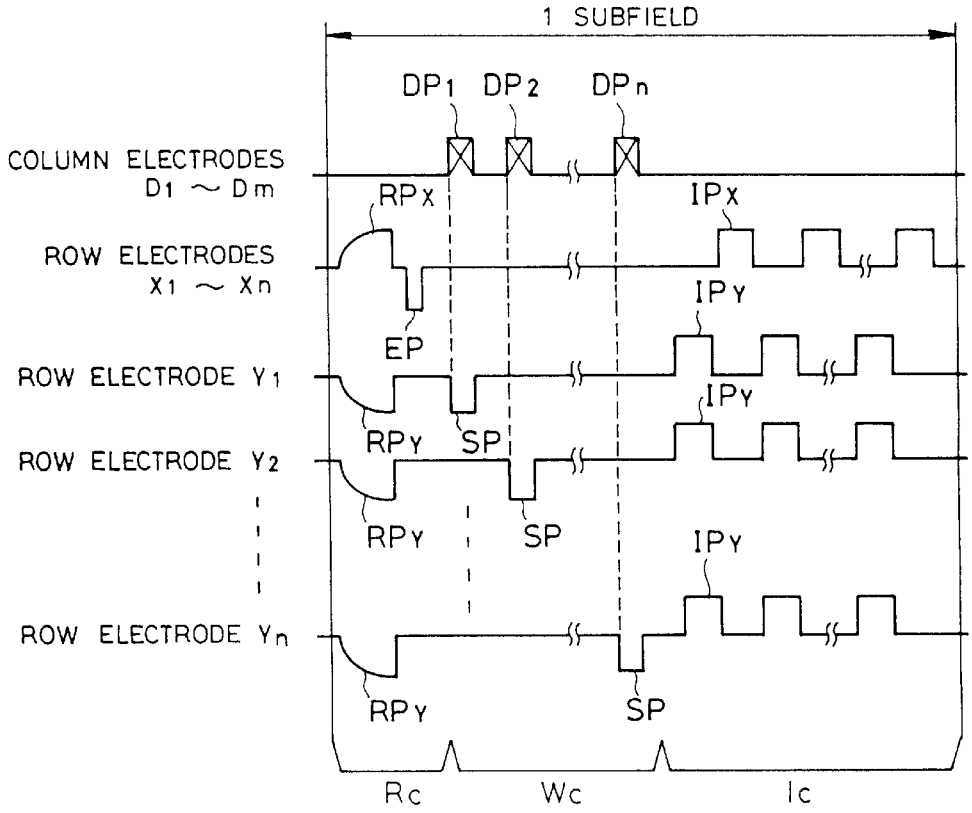
FIG. 2 is a timing chart showing timings of application of a variety of driving pulses to column electrodes and row electrodes of a plasma display panel in the conventional plasma display apparatus.

FIG. 2 is a timing chart showing applying timings at which the driving circuit 100 applies a variety of driving pulses to the row electrode pairs and the column electrodes of the PDP 10 in one subfield.

As shown in FIG. 2, the driving circuit 100 first applies a reset pulse $RP_X$ of positive polarity to the row electrodes $X_1$–$X_n$, and a reset pulse $RP_Y$ of negative polarity to the row electrodes Y1–$Y_n$. In response to the application of these reset pulses $RP_X$ and $RP_Y$, all the discharge cells in the PDP 10 are reset discharged to uniformly form a predetermined amount of wall charge in each of the discharge cells. Immediately after the formation of the wall charges, the driving circuit 100 applies an erasure pulse EP simultaneously to the row electrodes $X_1$–$X_n$ of the PDP 10. This causes an erasure discharge to occur in all the discharge cells to extinguish the wall charges (a simultaneous reset stage Rc). The simultaneous reset stage Rc initializes all the discharge cells in the PDP 10 into the state of "non-light emission cell." Next, the driving circuit 100 sequentially applies a group of pixel data pulses $DP_1$–$DP_n$ for one line corresponding to the input video signal to column electrodes $D_{1-m}$, and also generates a scanning pulse SP at the timing at which each of the pixel data pulses DP in the group is applied, and sequentially applies the scanning pulse SP to the row electrodes $Y_1$–$Y_n$ (pixel data writing stage Wc). In this event, a discharge occurs only in discharge cells at intersections of "rows" which are applied with the scanning pulse SP and "columns" which are applied with the high voltage pixel data pulses (selective writing discharge) to form wall charges in these discharge cells. The discharge cells, which have been initialized to the "non-light emitting cell" state in the simultaneous reset stage Rc" proceed to "light emitting cells." On the other hand, those discharge cells which are applied with the scanning pulse SP but also applied with low voltage image data pulses do not undergo the selective writing discharge, and remain in the initialized state in the simultaneous reset stage Rc, i.e., the "non-light emitting cell" state. Next, as illustrated in FIG. 2, the driving circuit 100 alternately and repeatedly applies sustain pulses $IP_X$, $IP_Y$ to the row electrodes $X_1$–$X_n$ and the row electrodes $Y_1$–$Y_n$ (light emission sustaining stage Ic). It should be noted that the number of times the sustain pulses $IP_X$, $IP_Y$ are applied in one subfield is set in accordance with weighting applied to each subfield. Here, those discharge cells in which the wall charge exists, i.e., only "light emitting cells" discharge each time they are applied with the sustain pulses $IP_X$, $IP_Y$ (sustain discharge). In other words, only discharge cells which have been set in "light emitting cells" in the pixel data writing stage Wc repeat the sustain discharge, which results in emitting light, a number of times corresponding to the weighting applied to each subfield to sustain their light emitting state.

The driving circuit 100 performs the operation as described in each subfield to represent a half-tone luminance corresponding to a video signal through the total number of times (in one field) of the sustain discharges caused in one subfield.

In this event, the electrode configuration of the PDP 10 illustrated in FIG. 1 experiences a potential difference generated due to the sustain pulses $IP_X$, $IP_Y$ even between respective display lines, for example, between a row electrode $Y_1$ of a display line L1 and a row electrode $X_2$ of a display line L2. Since this potential difference may cause an erroneous discharge irrelevant to pixel data between these display lines as described above, the pitch LP between the display lines must be sufficiently large to prevent the erroneous discharge, as illustrated in FIG. 1. This results in difficulties in improving the resolution by reducing the pitch LP between the display lines.

Also, as described above, since the plasma display panel consumes more power than CRT, liquid crystal display and so on, a reduction in power consumption is desired for the plasma display panel.

In the following, the present invention will be described in connection with an embodiment thereof with reference to the accompanying drawings.

Figure 3:
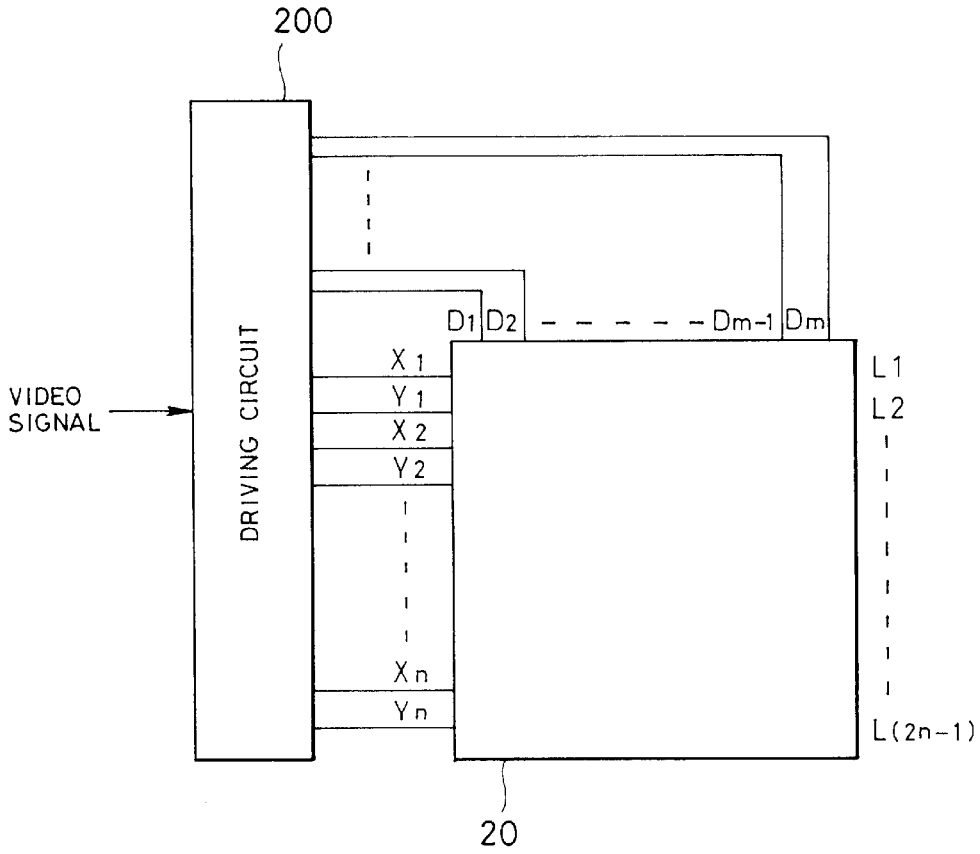
FIG. 3 is a diagram generally illustrating the structure of a plasma display apparatus according to the present invention.

FIG. 3 generally illustrates the configuration of a plasma display apparatus according to the present invention.

In FIG. 3, a plasma display panel (PDP) 20 comprises m column electrodes $D_1$–$D_m$ as data electrodes; and n row electrodes $X_1$–$X_n$ and n row electrodes $Y_1$–$Y_n$ which intersect the respective column electrodes $D_1$–$D_m$. The PDP 20 comprises (2n−1) display lines L1–L(2n−1) comprised of these row electrodes $X_1$–$X_n$ and row electrodes $Y_1$–$Y_n$.

Figure 4:
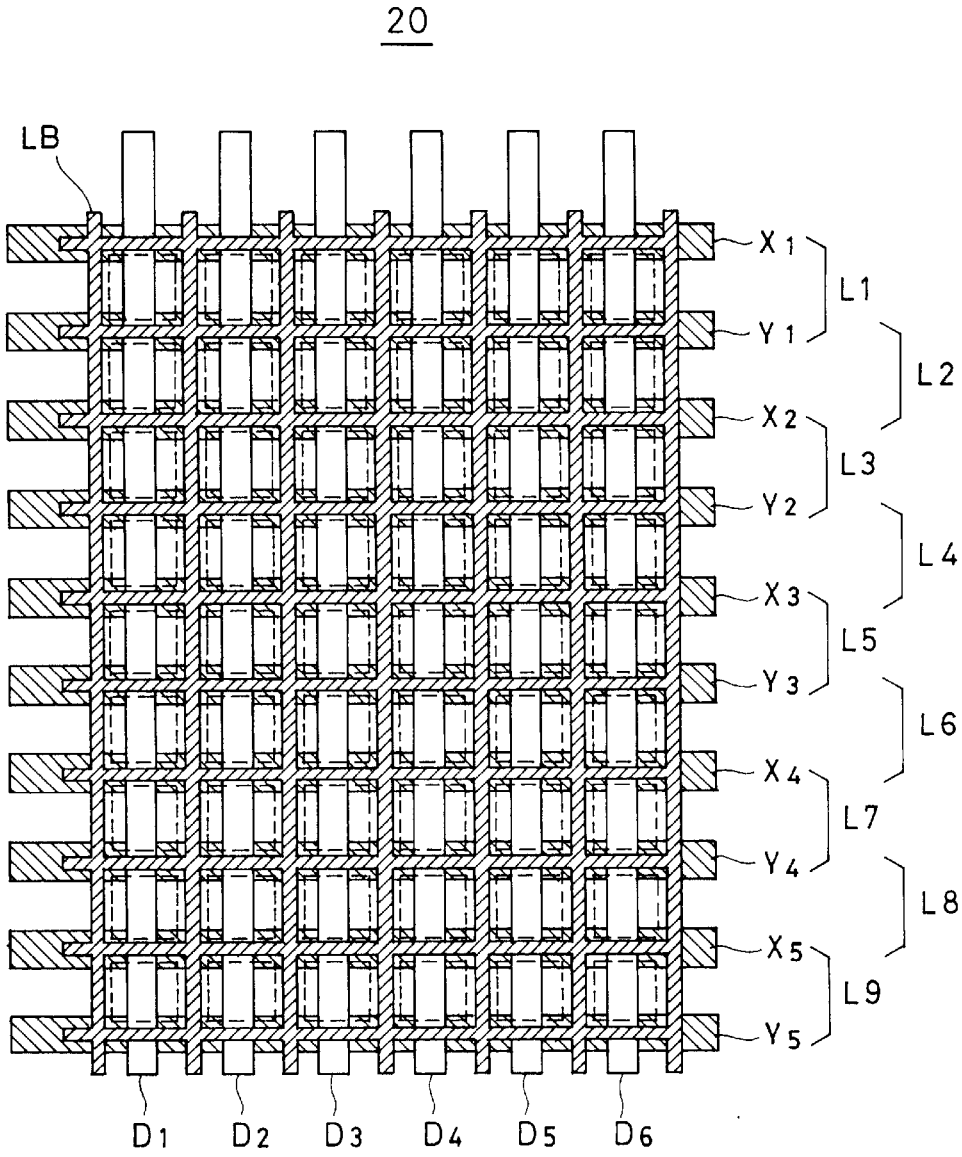
FIG. 4 is a diagram illustrating a portion of an overall electrode structure of a PDP 20 in the plasma display apparatus of the present invention.

FIG. 4 illustrates the structure of the electrodes in the PDP 20. Specifically, FIG. 4 illustrates intersections of column electrodes $D_1$–$D_6$ with row electrodes $X_1$–$X_5$ and row electrodes $Y_1$–$Y_5$, which are extracted from the entire PDP 20.

In FIG. 4, the row electrodes X and the row electrodes Y, which comprise display lines, are alternately formed on the inner surface of a front glass substrate (not shown). These row electrodes X, Y are covered with a dielectric layer. A discharge space (not shown) is formed between the dielectric layer and a back glass substrate (not shown), and is filled with a mixture of rare gases encapsulated therein as a discharge gas. Then, on the inner surface of the back glass substrate, i.e., the surface opposing the front glass substrate, respective column electrodes D are formed extending in a direction in which they intersect the row electrodes X, Y, as illustrated in FIG. 4. In this structure, discharge cells corresponding to pixels are formed at intersections of the row electrodes X, Y (or the row electrodes Y, X) with the column electrodes D, i.e., in portions including the discharge space within regions surrounded by broken lines in FIG. 4. Further, the PDP 20 is provided with ribs LB in a tessellation shape, as illustrated in FIG. 4, to prevent discharge light emitted from respective discharge cells from leaking into neighboring discharge cells.

A driving circuit 200 generates a variety of driving pulses for driving the PDP 20 in accordance with an input video signal, and applies the driving pulses to the column electrodes $D_1$–$D_m$ as well as to the row electrodes $X_1$–$X_n$ and the row electrodes $Y_1$–$Y_n$ of the PDP 20.

Figure 5A:
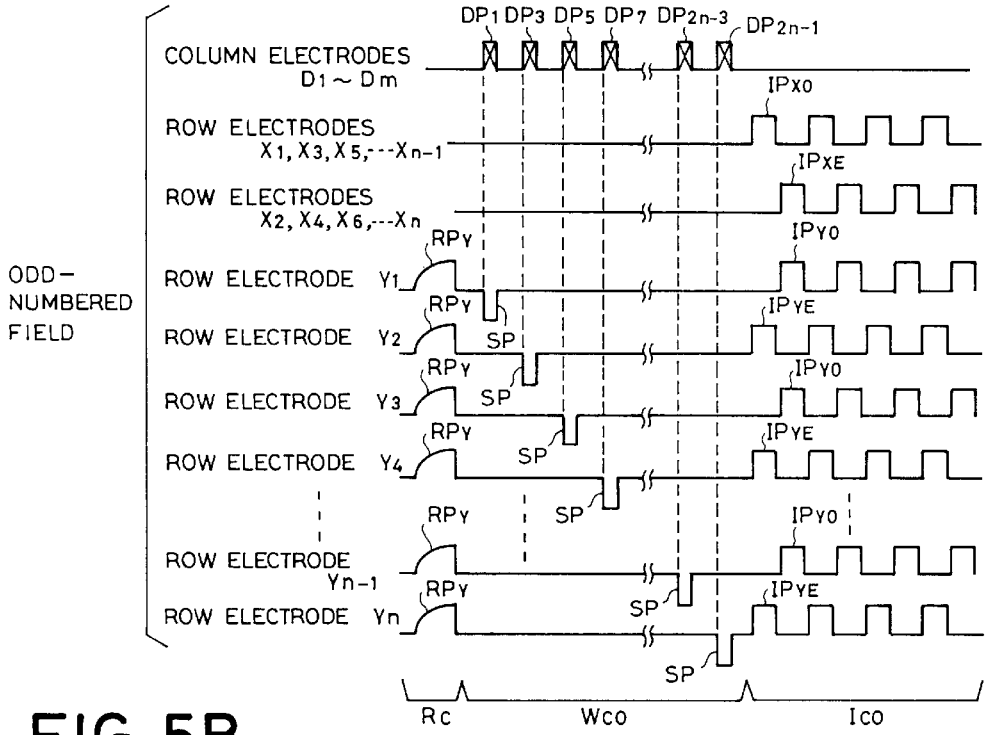
FIGS. 5A and 5B are timing charts showing timings of application of a variety of driving pulses are applied to column electrodes and row electrodes of the PDP 20 in the plasma display apparatus of the present invention.
Figure 5B:
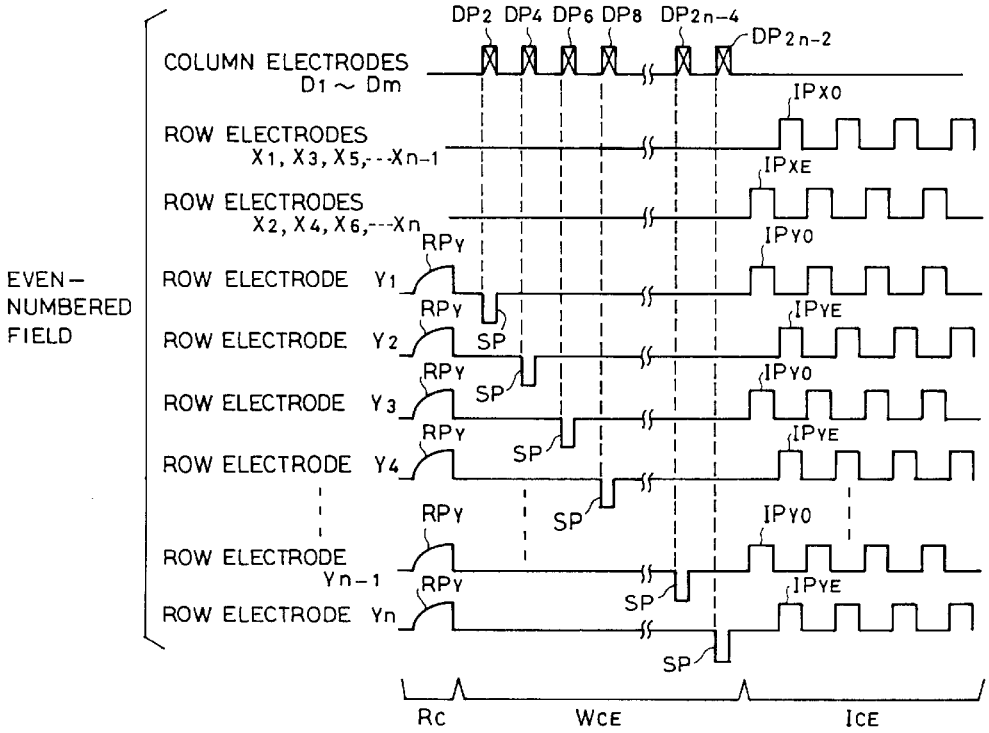

FIGS. 5A and 5B show timings of application, in one subfield, of a variety of driving pulses to the PDP 20 by the driving circuit 200.

First, in an odd-numbered field operation, the driving circuit 200 applies the column electrodes $D_1$–$D_m$, the row electrodes $X_1$–$X_n$ and the row electrodes $Y_1$–$Y_n$ of the PDP 20 with the variety of driving pulses at the timings shown in FIG. 5A.

More specifically, the driving circuit 200 first generates a reset pulse $RP_Y$ having a pulse voltage of positive polarity as shown in FIG. 5A, and simultaneously applies the reset pulse $RP_Y$ to all the row electrodes $Y_1$–$Y_n$ (simultaneous reset stage Rc).

The simultaneous reset stage Rc performed in this way causes a discharge to occur between the adjacent row electrodes X and Y, for example, between the respective row electrodes X and Y on display lines L1–L8 in FIG. 4. In this event, electrons and positive ions produced by the discharge are drawn by an electric field generated by a voltage between the row electrodes X and Y to form a wall charge of negative polarity on the row electrode Y. In this way, all the discharge cells are once set in "light emitting cells."

Next, the driving circuit 200 converts an input video signal to pixel data corresponding to respective pixels which comprise one screen [(2n−1) rows×m columns] of the PDP 20, and extracts from the pixel data those corresponding to odd-numbered display lines L1, L3, L5, . . . , L(2n−1). Then, the driving circuit 200 converts m pixel data for each odd-numbered display line to m pixel data pulses having voltages corresponding to respective logical levels. For example, the driving circuit 200 generates a pixel data pulse at a low voltage (zero volt) when the pixel data is at logical level "0," and a pixel data pulse at a high voltage when the pixel data is at logical level "1." Then, the driving circuit 200 sequentially applies the column electrodes $D_1$–$D_m$ with the m pixel data pulses as a group of pixel data pulses $DP_1$, $DP_3$, $DP_5$, . . . , $DP_{(2n-1)}$, each for a corresponding one of the odd-numbered display lines L1–L(2n−1), as shown in FIG. 5A. Further, the driving circuit 200 generates a scanning pulse SP having a pulse voltage of negative polarity and sequentially applies the scanning pulse SP to the row electrodes Y1–Yn simultaneously with the timing at which each of the pixel data pulses $DP_1$, $DP_3$, $DP_5$, . . . , $DP_{(2n-1)}$ are applied (pixel data writing stage $Wc_o$).

The pixel data writing stage $Wc_o$ performed as described above causes a discharge (selective erasure discharge) to occur in discharge cells which include column electrodes D applied with the high voltage pixel data pulse and row electrodes Y applied with the scanning pulse SP. For example, when the high voltage pixel data pulse is applied to the column electrode $D_1$ illustrated in FIG. 4 and the scanning pulse SP is applied to the row electrode Y1, the selective erasure discharge takes place in each of discharge cells which are formed at the intersection of the column electrode $D_1$ with the display line L1 and at the intersection of the column electrode $D_1$ with the display line L2. As a result, wall charges are extinguished only in discharge cells, in which the selective erasure discharge took place, of all the discharge cells. Stated another way, in this event, the discharge cells, which have been initialized to the "light emitting cell" state in the simultaneous reset stage Rc, proceed to the "non-light emitting cell" state. On the other hand, the selective erasure discharge does not take place in those discharge cells which have been applied with the scanning pulse SP but applied also with the low voltage pixel data pulse, so that the currently formed wall charges are maintained therein. In other words, in the discharge cells which have been formed with the wall charges of negative polarity on the row electrodes Y thereof, resulting from the execution of the simultaneous reset stage Rc, the wall charges remain therein as they are, so that the discharge cells maintain the "light emitting cell" state.

Next, the driving circuit 200 generates a sustain pulse $IP_{XO}$ having a pulse voltage of positive polarity as shown in FIG. 5A, and repeatedly applies this sustain pulse $IP_{XO}$ to odd-numbered row electrodes $X_1$, $X_3$, $X_5$, . . . , $X_{n-1}$ within the row electrodes $X_1$–$X_n$. After applying the first one of the sustain pulse $IP_{XO}$, the driving circuit 200 generates a sustain pulse $IP_{YO}$ having a pulse voltage of positive polarity at a timing deviated from the timing at which the sustain pulse $IP_{XO}$ is applied, and repeatedly applies the sustain pulse $IP_{YO}$ to odd-numbered row electrodes $Y_1$, $Y_3$, $Y_5$, . . . , $Y_{n-1}$ within the row electrodes $Y_1$–$Y_n$. Further, the driving circuit 200 generates a sustain pulse $IP_{XE}$ having a pulse voltage of positive polarity as shown in FIG. 5A at the same timing at which the sustain pulse $IP_{YO}$ is applied, and repeatedly applies the sustain pulse $IP_{XE}$ to even-numbered row electrodes $X_2$, $X_4$, $X_6$, . . . , $X_n$ within the row electrodes $X_1$–$X_n$. Also, the driving circuit 200 generates a sustain pulse $IP_{YE}$ having a pulse voltage of positive polarity at the same timing at which the sustain pulse $IP_{XO}$ is applied, and repeatedly applies the sustain pulse $IP_{YE}$ to even-numbered row electrodes $Y_2$, $Y_4$, $Y_6$, . . . , $Y_n$ within the row electrodes $Y_{1-Yn}$ (light emission sustaining stage $Ic_o$).

The light emission sustaining stage $Ic_o$ performed as described above causes a discharge (sustaining discharge) to occur when the odd-numbered row electrodes $X_1$, $X_3$, $X_5$, . . . , $X_{n-1}$ are applied with the first sustain pulse $IP_{XO}$ as shown in FIG. 5A, due to the influence of the wall charges of negative polarity which remain on the row electrodes Y of the associated discharge cells. Then, after the sustaining discharge comes to an end, wall charges of negative polarity are formed on the row electrodes X of the discharge cells. On the other hand, since the sustain pulse $IP_{YE}$ as shown in FIG. 5A is applied to the even-numbered row electrodes $Y_2$, $Y_4$, $Y_6$, . . . , $Y_n$ at the same timing as the sustain pulse $IP_{XO}$, no discharge takes place in this event. In other words, since the wall charges of negative polarity have been formed on the row electrodes Y at the time the sustain pulse $IP_{YE}$ is applied, no discharge takes place even if the sustain pulse $IP_{YE}$ of positive polarity is applied to the row electrodes Y. Subsequently, as shown in FIG. 5A, when the sustain pulse $IP_{YO}$ of positive polarity is applied to the odd-numbered row electrodes $Y_1$, $Y_3$, $Y_5$, . . . , $Y_{n-1}$, a sustaining discharge takes place due to the influence of the wall charges of negative polarity formed on the row electrodes X. Then, after the sustaining discharge comes to an end, wall charges of negative polarity are formed on the row electrodes Y of the discharge cells. However, the sustaining discharge does not take place even if the first sustain pulse $IP_{EX}$ as shown in FIG. 5A is applied to the even-numbered row electrodes $X_2$, $X_4$, $X_6$, . . . , $X_n$ at the same timing as the sustain pulse $IP_{YO}$. However, the sustaining discharge does not take place even if the first sustain pulse $IP_{YO}$ as shown in FIG. 5B is applied to the odd-numbered row electrodes $Y_1$, $Y_3$, $Y_5$, . . . $Y_{n-1}$ at the same time as the sustain pulse $IP_{XE}$. Specifically, since the wall charges of negative polarity have been formed on the row electrodes X at the time the sustain pulse $IP_{XE}$ is applied, no discharge takes place even if the sustain pulse $IP_{XE}$ of positive polarity is applied to the row electrodes X. In the light emission sustaining stage $Ic_o$, a sequence of the foregoing operations is repeatedly performed. Specifically, in the light emission sustaining stage $Ic_o$, the sustain pulse trains $IP_{XO}$, $IP_{YO}$ for promoting the discharge are alternately applied to the odd-numbered row electrodes X, Y, as shown in FIG. 5A. Then, the sustain pulses $IP_{YE}$, $IP_{XE}$ having the phases opposite to those of the sustain pulse trains $IP_{XO}$, $IP_{YO}$, as shown in FIG. 5A, are alternately applied to the even-numbered row electrodes Y, X for preventing erroneous discharges.

Thus, according to the driving sequence shown in FIG. 5A, the sustain discharge takes place only on the odd-numbered display lines L1, L3, L5, . . . , L(2n−1) to emit light for a display corresponding to an input video signal.

In an even field operation, on the other hand, the driving circuit 200 applies a variety of driving pulses to the column electrodes $D_1$–$D_m$, the row electrodes $X_1$–$X_n$, and the row electrodes $Y_1$–$Y_n$ of the PDP 20 at timings as shown in FIG. 5B.

Specifically, the driving circuit 200 first applies a reset pulse $RP_Y$ having a pulse voltage of positive polarity as shown in FIG. 5B and simultaneously applies the reset pulse $RP_Y$ to all the row electrodes $Y_1$–$Y_n$ (simultaneous reset stage Rc).

The simultaneous reset stage Rc performed in this way causes a discharge to occur between adjacent row electrodes X and Y, for example, between the respective row electrodes X and Y on the display lines L1–L8 in FIG. 4. In this event, electrons and positive ions produced by the discharge are drawn by an electric field generated by a voltage between the row electrodes X and Y to form a wall charge of negative polarity on the row electrode Y. In this way, all the discharge cells are once set in "light emitting cells."

Next, the driving circuit 200 converts an input video signal to pixel data corresponding to respective pixels which comprise one screen [(2n−1) rows×m columns] of the PDP 20, and extracts from the pixel data those corresponding to even-numbered display lines L2, L4, L6, . . . , L(2n−2). Then, the driving circuit 200 converts m pixel data for each even-numbered display line to m pixel data pulses having voltages corresponding to respective logical levels. For example, the driving circuit 200 generates a pixel data pulse at a low voltage (zero volt) when the pixel data is at logical level "0," and a pixel data pulse at a high voltage when the pixel data is at logical level "1." Then, the driving circuit 200 sequentially applies the column electrodes $D_1$–$D_m$ with the m pixel data pulses as a group of pixel data pulses $DP_2$, $DP_4$, $DP_6$, . . . , $DP_{(2n-2)}$, each for a corresponding one of the even-numbered display lines L2–L(2n−2), as shown in FIG. 5B. Further, the driving circuit 200 generates a scanning pulse SP having a pulse voltage of negative polarity and sequentially applies the scanning pulse SP to the row electrodes $Y_{1-Yn}$ simultaneously with the timing at which each of the pixel data pulses $DP_2$, $DP_4$, $DP_6$, . . . , $DP_{(2n-2)}$ in the group are applied (pixel data writing stage $WC_E$).

The pixel data writing stage $WC_E$ performed as described above causes a discharge (selective erasure discharge) to occur in discharge cells which include column electrodes D applied with the high voltage pixel data pulse and row electrodes Y applied with the scanning pulse SP. For example, when the high voltage pixel data pulse is applied to the column electrode $D_2$ illustrated in FIG. 4 and the scanning pulse SP is applied to the row electrode $Y_2$, the selective erasure discharge takes place in each of discharge cells which are formed at the intersection of the column electrode $D_2$ with the display line L3 and at the intersection of the column electrode $D_2$ with the display line L4. As a result, wall charges are extinguished only in discharge cells, in which the selective erasure display took place, of all the discharge cells. Stated another way, in this event, the discharge cells, which have been initialized to the "light emitting cell" state in the simultaneous reset stage Rc, proceed to the "non-light emitting cell" state. On the other hand, the selective erasure discharge does not take place in those discharge cells which have been applied with the scanning pulse SP but applied also with the low voltage pixel data pulse, so that the currently formed wall charges are maintained therein. In other words, in the discharge cells which have been formed with the wall charges of negative polarity on the row electrodes Y thereof, resulting from the execution of the simultaneous reset stage Rc, the wall charges remain therein as they are, so that the discharge cells maintain the "light emitting cell" state.

Next, the driving circuit 200 generates a sustain pulse $IP_{XE}$ having a pulse voltage of positive polarity as shown in FIG. 5B, and repeatedly applies this sustain pulse $IP_{XE}$ to even-numbered row electrodes $X_2$, $X_4$, $X_6$, . . . , $X_n$ within the row electrodes $X_{1-Xn}$. After applying the first one of the sustain pulse $IP_{XE}$, the driving circuit 200 generates a sustain pulse $IP_{YE}$ having a pulse voltage of positive polarity at a timing deviated from the timing at which the sustain pulse $IP_{XE}$ is applied, and repeatedly applies the sustain pulse $IP_{YE}$ to even-numbered row electrodes $Y_2$, $Y_4$, $Y_6$, . . . , $Y_n$ within the row electrodes $Y_1$–$Y_n$. Further, the driving circuit 200 generates a sustain pulse $IP_{XO}$ having a pulse voltage of positive polarity as shown in FIG. 5B at the same timing at which the sustain pulse $IP_{YE}$ is applied, and repeatedly applies the sustain pulse $IP_{XO}$ to odd-numbered row electrodes $X_1$, $X_3$, $X_5$, . . . , $X_{n-1}$ within the row electrodes $X_1$–$X_n$. Also, the driving circuit 200 generates a sustain pulse $IP_{YO}$ having a pulse voltage of positive polarity at the same timing at which the sustain pulse $IP_{XE}$ is applied, and repeatedly applies the sustain pulse $IP_{YO}$ to odd-numbered row electrodes $Y_{1,\ Y3}$, $Y_5$, . . . , $Y_{n-1}$ within the row electrodes $Y_1$–$Y_n$ (light emission sustaining stage $IC_E$) The light emission sustaining stage $IC_E$ performed as described above causes a discharge (sustaining discharge) to occur when the even-numbered row electrodes $X_2$, $X_4$, $X_6$, . . . , $X_n$ are applied with the first sustain pulse $IP_{XO}$ as shown in FIG. 5B, due to the influence of the wall charges of negative polarity which remain on the row electrodes Y of the associated discharge cells. Then, after the sustaining discharge comes to an end, wall charges are formed on the row electrodes X of the discharge cells. However, no sustaining discharge takes place even if the first sustain pulse $IP_{YO}$ as shown in FIG. 5B is applied to the odd-numbered row electrodes $Y_1$, $Y_3$, $Y_5$, . . . , $Y_{n-1}$ at the same timing as the sustain pulse $IP_{XE}$. In other words, since the wall charges of negative polarity have been formed on the row electrodes Y at the time the sustain pulse $IP_{YO}$ is applied, no sustaining discharge takes place even if the sustain pulse $IP_{YO}$ of positive polarity is applied to the row electrodes Y. Subsequently, as shown in FIG. 5B, when the first sustain pulse $IP_{YE}$ of positive polarity is applied to the even-numbered row electrodes $Y_2$, $Y_4$, $Y_6$, . . . , $Y_n$, a sustaining A discharge takes place due to the influence of the wall charges of negative polarity formed on the row electrodes X. Then, after the sustaining discharge comes to an end, wall charges of negative polarity are formed on the row electrodes Y of the discharge cells. However, the sustaining discharge does not take place even if the first sustain pulse $IP_{XO}$ of positive polarity as shown in FIG. 5B is applied to the odd-numbered row electrodes $X_1, X_3, X_5, \ldots, X_{n-1}$ at the same timing as the sustain pulse $IP_{YE}$. Specifically, since the wall charges of negative polarity have been formed on the row electrodes X at the time the sustain pulse $IP_{XO}$ is applied, no discharge takes place even if the sustain pulse $IP_{XO}$ of positive polarity is applied to the row electrodes X. In the light emission sustaining stage $IC_E$, a sequence of the foregoing operations is repeatedly performed.

Specifically, in the light emission sustaining stage $IC_E$, the sustain pulse trains $IP_{XE}$, $IP_{YE}$ for promoting the discharge are alternately applied to the even-numbered row electrodes X, Y, as shown in FIG. 5B. Then, the sustain pulses $IP_{YO}$, $IP_{XO}$ having the phases opposite to those of the sustain pulse trains $IP_{XE}$, $IP_{YE}$ as shown in FIG. 5B, are alternately applied to the odd-numbered row electrodes Y, X for preventing erroneous discharges.

Therefore, according to the driving sequence shown in FIG. 5B, the sustaining discharge takes place only on the even-numbered display lines L2, L4, L6, . . . , L(2n−2) to emit light for a display corresponding to an input video signal.

It should be noted that the foregoing embodiment employs a so-called interlace driving sequence which temporally separates the driving for the odd-numbered display lines from the driving for the even-numbered display lines. In this event, when display lines in one group are driven, row electrodes belonging to display lines in the other group are applied with a sustain pulse train, the phase of which is opposite to that of the sustain pulse train applied to drive the display line in the one group. In this way, erroneous discharges are prevented between the even-numbered display lines and the odd-numbered display lines.

As described above, in the plasma display apparatus according to a first feature of the present invention, a pair of row electrodes is shared to drive the odd-numbered display lines and to drive the even-numbered display lines. Also, the plasma display apparatus employs, as a pixel data writing method, the so-called selective erasure address method which involves previously forming wall charges in all discharge cells, and selectively erasing the wall charges to set respective discharge cells in a light emitting cell state or a non-light emitting cell state corresponding to an input video signal. With this configuration, the number of display lines of pixels can be increased more than the number of row electrode pairs to provide a higher definition display and to reduce the power consumption.

Next, a second embodiment of the present invention will be described below with reference to the accompanying drawings.

Figure 6:
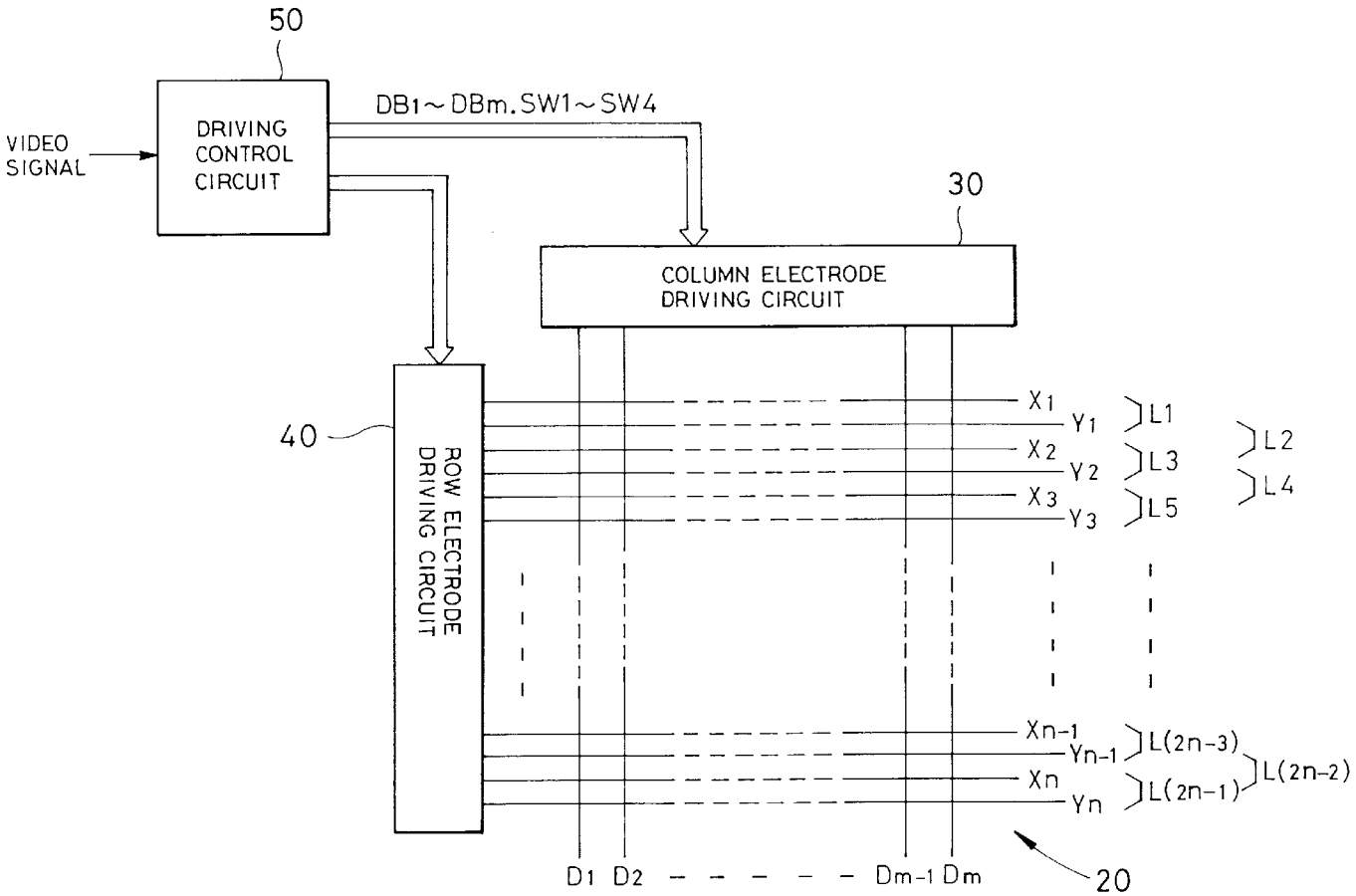
FIG. 6 is a diagram generally illustrating the structure of a plasma display apparatus according to a second aspect of the present invention.

FIG. 6 generally illustrates the configuration of a plasma display apparatus according to a second feature of the present invention.

In FIG. 6, a driving control circuit 50 generates a variety of timing signals for driving a PDP 20 to emit light based on a subfield method, in response to a synchronization signal in an input video signal, and supplies the timing signals to a row electrode driving circuit 40. The driving control circuit 50 also converts the input video signal to pixel data corresponding to respective pixels which comprise one screen [(2n−1) rows×m columns] of the PDP 20, and groups the pixel data into m pixel data bits $DB_1$–$DB_m$ for each display line. Then, in an odd-numbered field period, the driving control circuit 50 sequentially supplies the column electrode driving circuit 30 with the pixel data bits DB1–DBm corresponding to odd-numbered display lines L1, L3, L5, . . . , L(2n−1), respectively, for each odd-numbered display line. In an even-numbered field period, on the other hand, the driving control circuit 50 sequentially supplies the column electrode driving circuit 30 with the pixel data bits $DB_1$–$DB_m$ corresponding to even-numbered display lines L2, L4, L6, . . . , L(2n−2), respectively, for each even-numbered display line. The driving control circuit 50 also generates switching signals SW1–SW4, each of which varies in accordance with a predetermined sequence, in synchronism with the timing at which the pixel data bit DB is supplied for each display line, and supplies the column electrode driving circuit 30 with these switching signals SW1–SW4.

The column electrode driving circuit 30 generates m pixel data pulses having voltages corresponding to logical levels of the respective pixel data bits $DB_1$–$DB_m$ in response to the switching signals SW1–SW4, and applies column electrodes $D_1$–$D_m$ of the PDP 20 simultaneously with these pixel data pulses.

Figure 7:
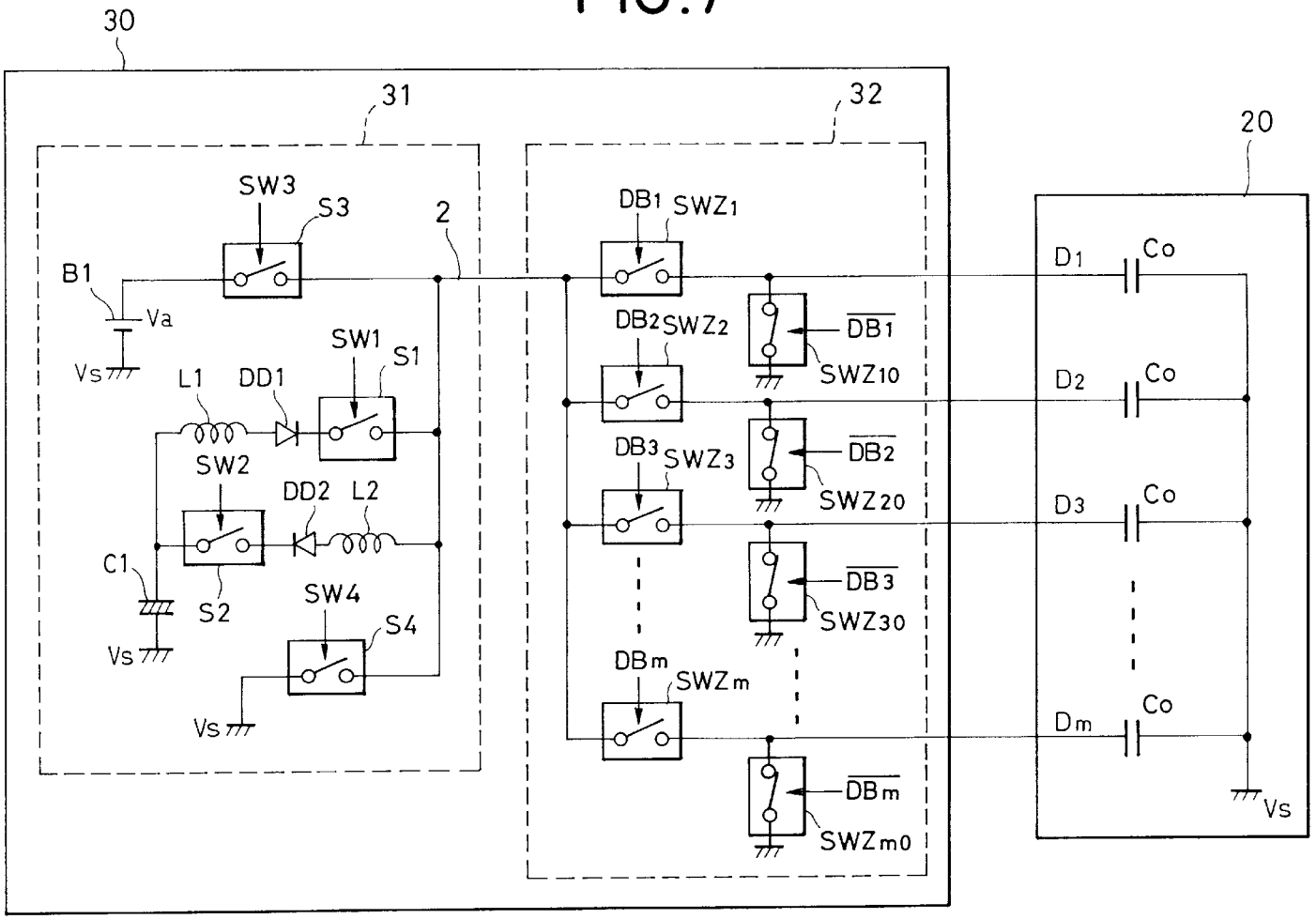
FIG. 7 is a circuit diagram illustrating the internal configuration of a column electrode driving circuit 30.

FIG. 7 illustrates the internal configuration of the column electrode driving circuit 30.

As illustrated in FIG. 7, the column electrode driving circuit 30 comprises a power supply circuit 31 and a pixel data pulse generator circuit 32.

The power supply circuit 31 includes a capacitor C1 which has one end connected to a PDP ground potential Vs serving as a ground potential of the PDP 20. A switching element S1 is in OFF state when it is supplied with the switching signal SW1 at logical level "0" from the driving control circuit 50. On the other hand, the switching element S1 turns ON when the switching signal SW1 changes to logical level "1" to apply a potential generated at the other end of the capacitor C1 to a power supply line 2 through a coil L1 and a diode DD1. This causes the capacitor C1 to begin discharging, and a potential resulting from the discharge is applied onto the power supply line 2. A switching element S2 is in OFF state when it is supplied with the switching signal SW2 at logical level "0" from the driving control circuit 50. On the other hand, the switching element S2 turns ON when the switching signal SW2 changes to logical level "1" to apply the potential on the power supply line 2 to the other end of the capacitor C1 through a coil L2 and a diode DD2. In this event, the capacitor C1 is charged with the potential on the power supply line 2. A switching element S3 is in OFF state when it is supplied with the switching signal SW3 at logical level "0" from the driving control circuit 50. On the other hand, the switching element S3 turns ON when the switching signal SW3 changes to logical level "1" to apply a power supply potential Va generated by a DC power supply B1 onto the power supply line 2. The DC power supply B1 has a negative terminal grounded at the PDP ground potential Vs. A switching element S4 is in OFF state when it is supplied with the switching signal SW4 at logical level "0" from the driving control circuit 50. On the other hand, the switching element S4 turns ON when the switching signal SW4 changes to logical level "1" to ground the power supply line 2 to the PDP ground potential Vs.

The pixel data pulse generator circuit 32 comprises switching elements $SWZ_1$–$SWZ_m$ and $SWZ_{10}$–$SWZ_{m0}$ which are independently controlled ON/OFF in response to one line (m) of pixel data bits $DB_1$–$DB_m$ supplied from the driving control circuit 50. Each of the switching elements $SWZ_1$–$SWZ_m$ remains in ON state as long as the pixel data bit DB supplied thereto is at logical level "1" to apply a potential existing on the power supply line 2 to the column electrodes $D_1$–$D_m$ of the PDP 20. Each of the switching elements $SWZ_{10}$–$SWZ_{m0}$ remains in ON state as long as the corresponding pixel data bit DB is at logical level "0" to ground a potential on an associated column electrode to the PDP ground potential Vs.

Figure 8:
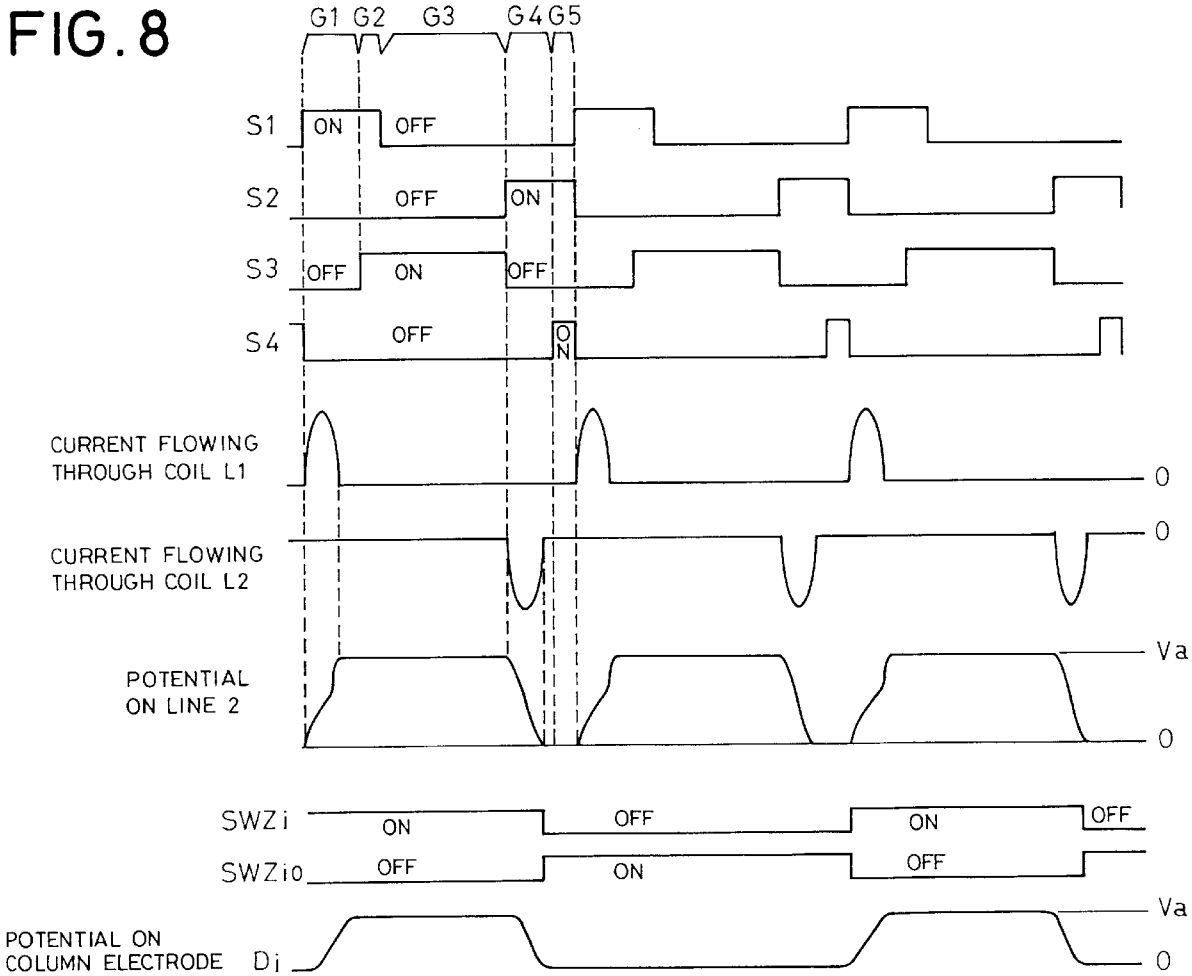
FIG. 8 is a timing chart showing waveforms which represent internal operations in the column electrode driving circuit 30.

FIG. 8 is a timing chart showing waveforms which represent internal operations in the column electrode driving circuit 30.

First, the driving control circuit 50 supplies the power supply circuit 31 with the switching signals SW2–SW4 at logical level "0" and the switching signal SW1 at logical level "1" (driving stage G1). This causes only the switching element S1 of the switching elements S1–S4 to turn ON to discharge a charge accumulated on the capacitor C1. Therefore, when the pixel data bit DB is at logical level "1" for this period, a switching element $SWZ_1$ turns ON, allowing a current to flow into a column electrode Di through the coil L1, diode DD1, switching element S1 and switching element $SWZ_i$. Then, a load capacitance $C_o$ of the PDP 20 is charged with this current. In this event, the potential on the column electrode Di gradually increases by a time constant determined by the coil L1 and the load capacitance $C_o$ as shown in FIG. 8.

The driving control circuit 50 switches only the switching signal SW3 to logical level "1" at the time one half of a resonance period, determined by the coil L1 and the load capacitance $C_o$, is elapsed (driving stage G2). This causes the switching element S3 to turn ON to apply the power supply potential Va generated by the DC power supply B1 onto the power supply line 2, so that the potential on the column electrode $D_i$ is fixed to the power supply potential Va as shown in FIG. 8.

Next, the driving control circuit 50 switches the switching signal SW1 to logical level "0" (driving stage G3). This causes the switching element S1 to turn OFF to stop a resonant operation by the coil L1 and the load capacitance $C_o$.

Next, the driving control circuit 50 switches the switching signal SW2 to logical "1" and the switching signal SW3 to logical level "0," respectively (driving stage G4).

This results in discharging the charge accumulated on the load capacitance $C_o$. Therefore, a current flows into the capacitor C1 through the switching element $SWZ_i$, coil L2, diode DD2 and switching element S2 to charge the capacitor C1. In this event, the potential on the column electrode Di gradually decreases by a time constant determined by the coil L2 and the load capacitance $C_o$, as shown in FIG. 8.

Then, at the time one half of the resonance period, determined by the coil L1 and the load capacitance, is elapsed, the driving control circuit 50 supplies the power supply circuit 31 with the switching signal SW4 at logical level "1" in the form of short pulse in order to turn ON the switching element S4 only for a predetermined short period of time (driving stage G5). This causes the power supply line 2 to be grounded to the PDP ground potential Vs only for the short period of time. Meanwhile, a current flows into the switching element S4 from the PDP 20 through the switching element $SWZ_i$ and the power supply line 2.

The driving control circuit 50 repeatedly supplies the column electrode driving circuit 30 with the switching signals SW1–SW4 having a sequence as shown in FIG. 8 to repeatedly perform a sequence of operations consisting of the driving stages G1–G5. During this sequence of operations, when the pixel data bit DB is at logical level "1," the power supply potential Va generated on the power supply line 2 is applied to the column electrode D, as shown in FIG. 8, and serves as a high voltage pixel data pulse. On the other hand, when the pixel data bit DB is at logical level "0," causing a switching element $SWZ_{i0}$ to turn ON, the column electrode D is grounded to the PDP ground potential Vs which serves as a low voltage pixel data pulse.

As described above, in the column electrode driving circuit 30, a charge accumulated on the capacitor C1 is selectively discharged through a first switching current path comprised of the coil L1, diode DD1 and switching element S1 to generate a rising edge of a pixel data pulse. Next, the power supply potential is applied on the power supply line 2 through a second switching current path comprised of the DC power supply B1 and the switching element S3 to generate the pulse voltage Va as the pixel data pulse. Next, the capacitor C1 is charged selectively with a charge accumulated on the load capacitance $C_o$ existing on column electrodes through the power supply line 2 for recovering the charge through a third switching current path comprised of the coil L2, diode DD2 and the switching element S2, to generate a falling edge of the pixel data pulse. Then, finally, the power supply line 2 is forcedly grounded only for a predetermined short period of time through the switching element S4 as a fourth switching current path to determine a minimum potential as the pixel data pulse.

As described above, the column electrode driving circuit 30 is configured to generate the pixel data pulse through the resonance-based operation using the resonance circuit comprised of a capacitor and a coil. Since the pixel data pulse can be generated with a DC power supply having a lower voltage value than a peak value of the pixel data pulse, the power consumption can be reduced.

The row electrode driving circuit 40 generates a variety of driving pulses (later described) in response to a variety of timing signals supplied from the driving control circuit 50, and applies the driving pulses to the row electrodes $X_1$–$X_n$ and the row electrodes $Y_1$–$Y_n$.

Since the row electrode driving circuit 40 and the column electrode driving circuit 30 apply the PDP 10 with a variety of driving pulses at applying timings in one subfield identical to those shown in FIGS. 5A, 5B, description thereon will not be repeated.

While the foregoing embodiment has been described for an example in which a resonance circuit is used as the power supply circuit 31 of the column electrode driving circuit 30, a pump up circuit may be employed instead of the resonance circuit.

Figure 9:
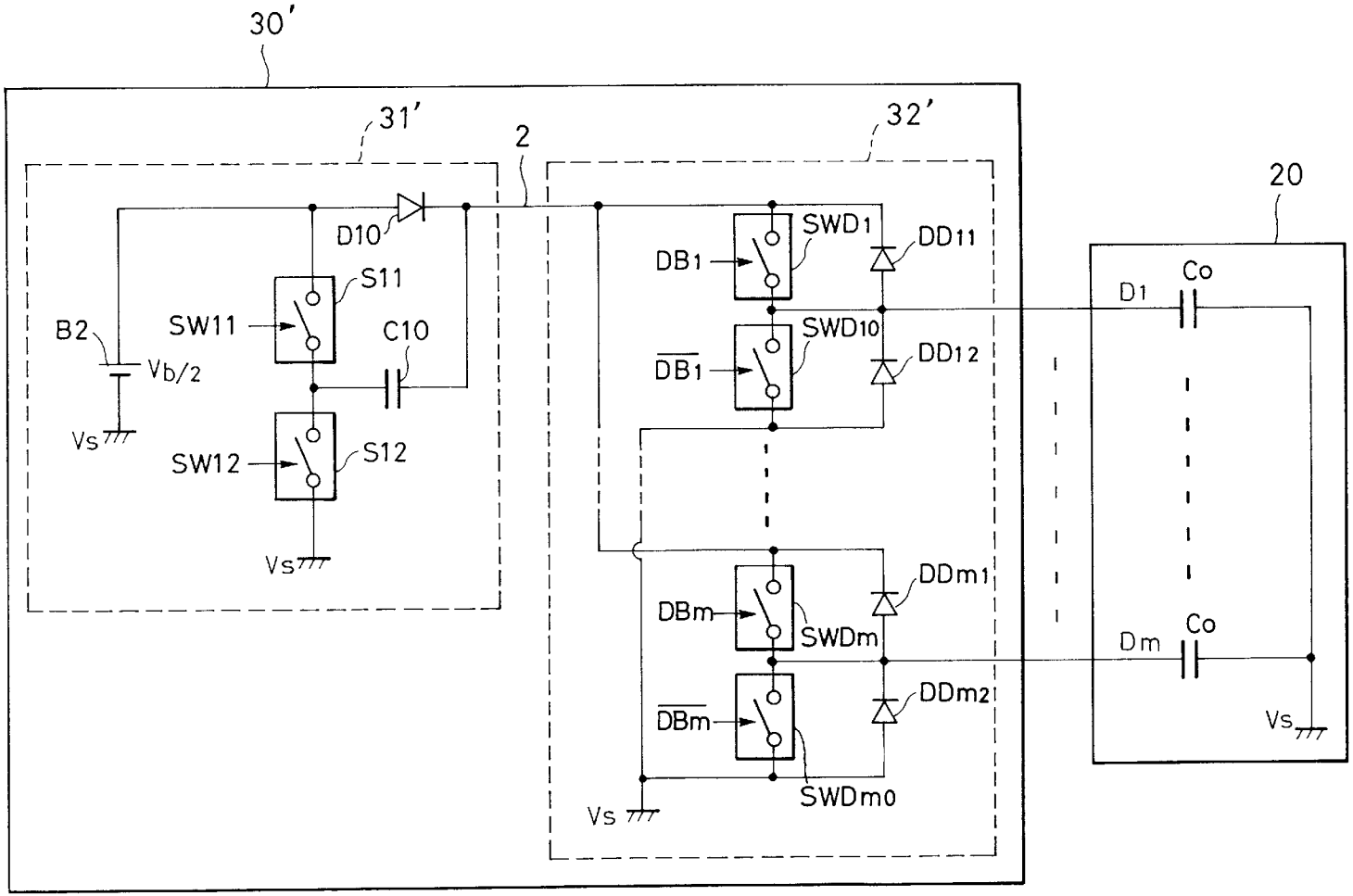
FIG. 9 is a circuit diagram illustrating the internal configuration of a column electrode driving circuit 30'.

FIG. 9 illustrates the internal configuration of a column electrode driving circuit 30' which employs a pump up circuit as a power supply circuit.

As illustrated in FIG. 9, the column electrode driving circuit 30' comprises a power supply circuit 31' and a pixel data pulse generator circuit 32'.

In the power supply circuit 31', a DC power supply B2 has a positive terminal connected to a power supply line 2 through a diode D10, and a negative terminal grounded to a PDP ground potential Vs. A switching element S11 has one end connected to the positive terminal of the DC power supply B2 and the other end connected to one end of a capacitor C10. A switching element S12 has one end connected to the one end of the capacitor C10 and the other end grounded to the PCP ground potential Vs. The capacitor C10 has the other end connected to the power supply line 2.

The switching element S11 is in OFF state when it is supplied with a switching signal SW11 at logical level "0"

from the driving control circuit 50. The switching element S12 is in ON state when it is supplied with a switching signal SW12 at logical level "1" from the driving control circuit 50. Then, when the switching element S11 is in OFF state and the switching element S12 is in ON state, a power supply potential Vd/2 is applied onto the power supply line 2 by the DC power supply B2 through the diode D10, and the one end of the capacitor C10 is grounded to the PDP ground potential Vs.

When the switching signal SW11 is at logical level "1" and the switching signal SW12 is at logical level "0," the switching element S11 turns ON and the switching element S12 turns OFF, causing a potential produced at the other end of the capacitor C10 to be applied onto the power supply line 2. In this way, the capacitor C10 starts discharging, and the power supply line 2 is applied with a potential Vd which is the sum of a potential Vd/2 produced by the discharge and the power supply potential Vd/2.

The pixel data pulse generator circuit 32' comprises switching elements $SWD_1$–$SWD_m$ and $SWD_1$–$SWD_{m0}$ which are independently controlled ON/OF in response to one line (m) of corresponding pixel data bits $DB_1$–$DB_m$ supplied from the driving control circuit 50. Also, diodes $DD_{11}$–$DD_{m1}$ are connected in parallel with the switching elements $SWD_1$–$SWD_m$, while diodes $DD_{12}$–$DD_{m2}$ are connected in parallel with the switching elements $SWD_{10}$–$SWD_{n0}$. Each of the switching elements $SWD_1$–$SWD_m$ is in ON state as long as a pixel data bit DB supplied thereto is at logical level "1" to apply a potential existing on the power supply line 2 to row electrodes $D_1$–$D_m$ of the PDP 10. Each of the switching elements $SWD_{10}$–$SWD_{m0}$ is in ON state as long as a pixel data bit DB supplied thereto is at logical level "0" to ground potentials on the column electrodes $D_1$–$D_m$ to the PDP ground potential Vs.

Figure 10:
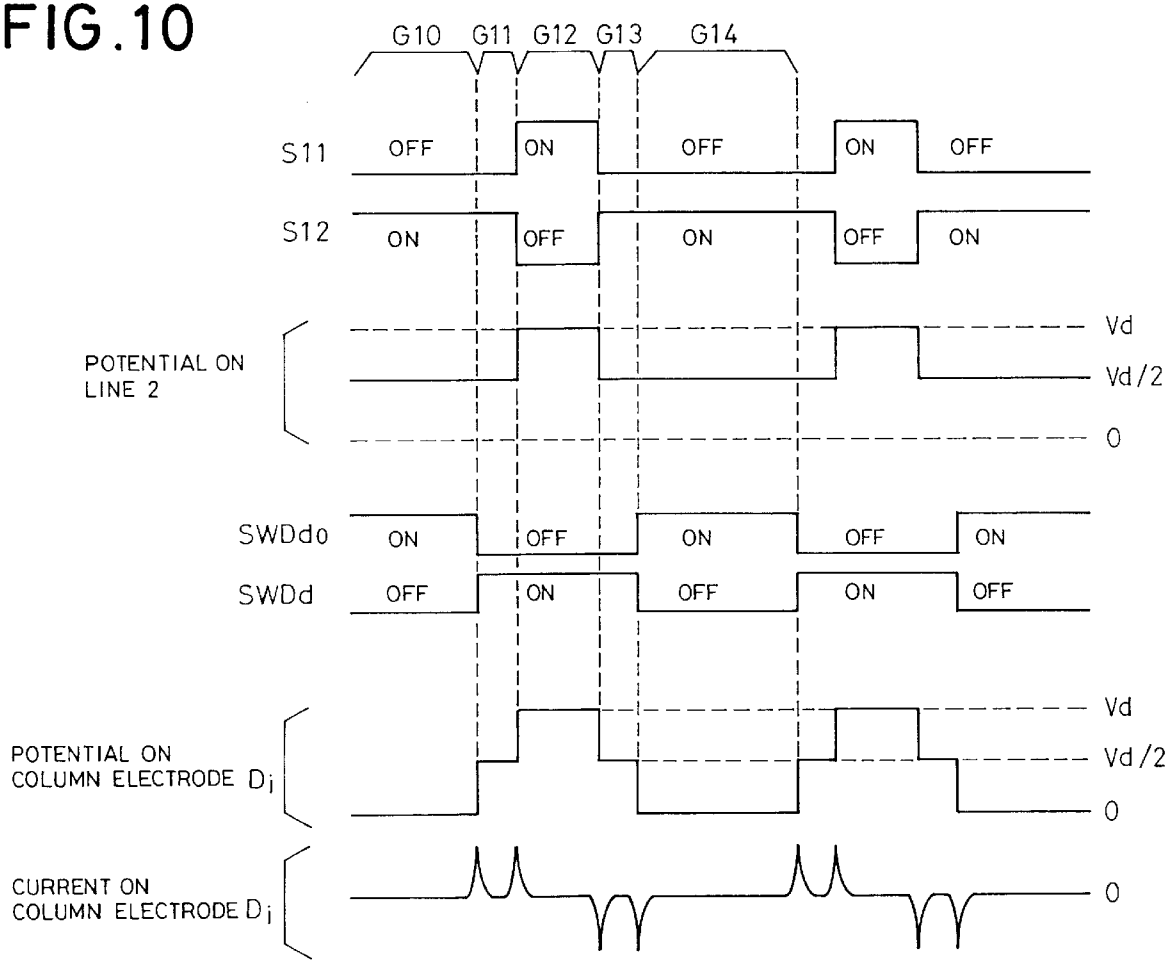
FIG. 10 is a timing chart showing waveforms which represent internal operations in the column electrode driving circuit 30'.

FIG. 10 is a timing chart showing waveforms which represent internal operations in the column electrode driving circuit 30' illustrated in FIG. 9.

First, the driving control circuit 50 supplies the switching signal SW11 at logical level "0" and the switching signal SW12 at logical level "1" (driving stage G10). This causes the switching element S11 to turn OFF and the switching element S12 to turn ON, resulting in the potential on the power supply line 2 equal to the power supply potential Vd/2.

In the meantime, when the pixel data bit DB is at logical level "0," a switching element $SWD_i$ turns OFF, and a switching element $SWD_{i0}$ turns ON, resulting in the potential on a column electrode $D_i$ equal to the PDP ground potential Vs.

On the other hand, when the pixel data bit DB is at logical level "1," the switching element $SWD_i$ turns ON, and the switching element $SWD_{i0}$ turns OFF, causing a current to flow from the DC power supply B2 to the column electrode $D_i$ through the diode D10 and the switching element $SWD_i$. Then, a load capacitance $C_0$ of the PDP 10 is charged with this current, causing the potential on the column electrode $D_i$ to increase to the power supply potential Vd/2 (driving stage G11).

Next, at the time a predetermined period of time is elapsed from the time at which the pixel data bit DB changes to logical level "1," the switching signal SW11 is switched to logical level "1" and the switching signal SW12 is switched to logical level "0," respectively (driving stage G12). Thus, the power supply line 2 is applied with a potential Vd which is the sum of the power supply potential Vd/2 and the potential Vd/2 on the capacitor C10, causing the capacitor C10 to begin discharging, followed by a current flowing into the column electrode $D_i$ through the switching element S11, capacitor C10 and the switching element $SWD_i$. Then, the load capacitance $C_o$ of the PDP 10 is charged with this current, and the potential on the column electrode $D_i$ is increased from the power supply potential Vd/2 to the potential Vd by the potential Vd/2 generated by the discharging capacitor C10.

Next, at the time a predetermined period of time is elapsed from the time at which the switching signal SW11 changes to logical level "1," the switching signal SW11 is switched to logical level "0" and the switching signal SW12 is switched to logical level "1," respectively (driving stage G13). Thus, the charge accumulated on the load capacitance $C_0$ is discharged. As a result, a current flows through the switching element $SWD_i$, capacitor C10 and switching element S12, and charges the capacitor C10. In this event, the potential on the column electrode $D_i$ and the potential on the power supply line 2 are decreased from Vd to Vd/2 (power supply potential) by the potential Vd/2.

Next, when the pixel data bit DB changes to logical level "0" at the time a predetermined period of time is elapsed from the time at which the switching signal S11 changes to logical level "0," the switching element $SWD_i$ turns OFF, and the switching element $SWD_{i0}$ turns ON (driving stage G14). Thus, the charge accumulated on the load capacitance $C_0$ is discharged. As a result, a current flows through the switching element $SWD_{i0}$, and the potential on the column electrode $D_i$ is grounded to the PDP ground potential Vs.

The driving control circuit 50 repeatedly supplies the column electrode driving circuit 20' with the switching signals SW11, SW12, which have a sequence as shown in FIG. 10, to repetitively execute a sequence of operations comprised of the driving stages G10–G14. In the meantime, when the pixel data bit DB is at logical level "1," the potentials Vd/2, Vd produced on the power supply line 2 are applied to a column electrode D and serves as a high voltage pixel data pulse, as shown in FIG. 10. On the other hand, when the pixel data bit DB is at logical level "0," the switching element $SWD_{i0}$ turns ON, and the column electrode D is grounded to the PDP ground potential Vs which serves as a low voltage pixel data pulse.

As described above, in the column electrode driving circuit 30', the power supply line 2 is applied with the power supply potential Vd/2 through a current path comprised of the DC power supply B2 and the diode D10. Then, the power supply line 2 is applied with the potential Vd which is produced by selectively adding the potential Vd/2 on the capacitor C10, on which a charge has been accumulated, to the power supply potential Vd/2 through a first switching current path comprised of the switching element S11. Further, the capacitor C10 is charged selectively with a charge accumulated on the load capacitance $C_o$ through the power supply line 2 for recovering the charge through a second switching current path comprised of the switching element S12.

Therefore, according to the column electrode driving circuit 30' which employs the pump up circuit as illustrated in FIG. 9, the pixel data pulse presents an output waveform which includes stepped rising and falling edges as shown in FIG. 10, so that the power consumption is reduced.

As described above, in the plasma display apparatus according to a second feature of the present invention, a pair of row electrodes X, Y is commonly used for driving odd-numbered display lines as well as for driving even-numbered display lines. Thus, since the number of display lines on the screen can be increased more than the number of row electrode pairs, a high definition display can be achieved. Further, in the present invention, the resonance, produced by a resonance circuit, is utilized to generate a pixel data pulse having a predetermined pulse voltage value which is applied to row electrodes. Since the pixel data pulse can be generated with a DC power supply having a lower voltage value than a peak value of the pixel data pulse, the power consumption can be reduced.

What is claimed is:

1. A plasma display apparatus for displaying an image corresponding to an input video signal, comprising:

a plasma display panel including a plurality of first row electrodes and second row electrodes extending in a horizontal direction and formed in alternation, a discharge space filled with a discharge gas, and a plurality of column electrodes formed opposite to and extending in a direction perpendicular to said first row electrodes and said second row electrodes through said discharge space, said plasma display panel also including discharge cells corresponding to pixels, formed at respective intersections of said first row electrodes and second row electrodes with said column electrodes, a spacing between each of said first row electrodes and each of said second row electrodes being conformed to a display line on the screen;

a power supply circuit including a capacitor, a first switching current path for selectively discharging a charge accumulated on said capacitor to supply said charge to a power supply line, a second switching current path for selectively applying a power supply potential to said power supply line, and a third switching current path for selectively charging said capacitor with charges accumulated on said column electrodes through said power supply line; and a pixel data pulse generator circuit for connecting said power supply line to said column electrodes for a predetermined period of time in response to said input video signal to generate pixel data pulses corresponding to said input video signal and applying said pixel data pulses onto said column electrodes, wherein said first switching current path includes a first coil having one end connected to one end of said capacitor, and a first switching element for applying said power supply line with a potential generated at the other end of said first coil; and said second switching current path includes a second coil having one end connected to said power supply line, and a second switching element for grounding the other end of said second coil.

2. A plasma display apparatus according to claim 1, further comprising:

reset driving means for causing a reset discharge to occur for forming wall charges in all of said discharge cells;

write driving means for causing a selective erasure discharge to occur for selectively erasing said wall charges formed in said discharge cells in accordance with said input video signal; and light emission sustain driving means for causing a sustaining discharge to occur for forcing only discharge cells formed with said wall charges therein out of said discharge cells to repeatedly emit light.

3. A plasma display apparatus according to claim 2, wherein said light emission sustain driving means includes:

first light emission sustain driving means for causing said sustaining discharge to occur for forcing discharge cells formed with said wall charges therein to repeatedly emit light, within said discharge cells belonging to each of odd-numbered display lines of said display lines; and second light emission sustain driving means for occurring said sustaining discharge to occur for forcing discharge cells formed with said wall charges therein to repeatedly emit light, within said discharge cells belonging to each of even-numbered display lines of said display lines.

4. A plasma display apparatus according to claim 3, wherein:

said first light emission sustain driving means repeatedly applies a sustain pulse for causing said sustaining discharge to occur to each of odd-numbered row electrodes of said first row electrodes and each of even-numbered row electrodes of said second row electrodes at a first timing, and repeatedly applies said sustain pulse to each of even-numbered row electrodes of said first row electrodes and each of odd-numbered row electrodes of said second row electrodes at a second timing with a phase opposite to that of said first timing; and said second light emission sustain driving means repeatedly applies said sustain pulse to each of even-numbered row electrodes of said first row electrodes and each of odd-numbered row electrodes of said second row electrodes at a first timing, and repeatedly applies said sustain pulse to each of odd-numbered row electrodes of said first row electrodes and each of even-numbered row electrodes of said second row electrodes at said second timing.

5. A plasma display apparatus according to claim 3, wherein said first light emission sustain driving means and said second light emission sustain driving means alternately perform respective driving operations thereof every unit display period in said input video signal.

* * * * *